US009923264B2

(12) United States Patent
Kim et al.

(10) Patent No.: US 9,923,264 B2
(45) Date of Patent: Mar. 20, 2018

(54) ANTENNA AND ELECTRONIC DEVICE COMPRISING THEREOF

(71) Applicant: Samsung Electronics Co., Ltd., Suwon-si, Gyeonggi-do (KR)

(72) Inventors: Yeon Woo Kim, Suwon-si (KR); Jung Sik Park, Suwon-si (KR); Seung Gil Jeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/146,337

(22) Filed: May 4, 2016

(65) Prior Publication Data

US 2016/0329628 A1 Nov. 10, 2016

(30) Foreign Application Priority Data

May 8, 2015 (KR) ..... 10-2015-0064653

(51) Int. Cl.

*H01Q 1/24* (2006.01)
*H01Q 1/38* (2006.01)
*H01Q 9/06* (2006.01)

(52) U.S. Cl.

CPC ..... *H01Q 1/243* (2013.01); *H01Q 1/38* (2013.01); *H01Q 9/06* (2013.01)

(58) Field of Classification Search

CPC ..... H01Q 1/243
See application file for complete search history.

(56) References Cited

U.S. PATENT DOCUMENTS

| | | | | |
|---|---|---|---|---|
| 7,570,218 | B2 | 8/2009 | Tsujimura et al. | |
| 7,659,855 | B2 * | 2/2010 | Mashima | H01Q 1/243 343/702 |
| 8,098,204 | B2 | 1/2012 | Tsujimura et al. | |
| 8,587,491 | B2 | 11/2013 | Badaruzzaman et al. | |
| 8,643,550 | B2 | 2/2014 | Chiu et al. | |
| 8,884,825 | B2 | 11/2014 | Badaruzzaman et al. | |
| 8,896,489 | B2 | 11/2014 | Larsen et al. | |
| 9,099,774 | B2 | 8/2015 | Larsen et al. | |
| 9,667,296 | B2 | 5/2017 | Kim et al. | |
| 2006/0055608 | A1 | 3/2006 | Minemura | |
| 2007/0241971 | A1 | 10/2007 | Tsujimura et al. | |
| 2009/0174615 | A1 | 7/2009 | Tsujimura et al. | |
| 2009/0322629 | A1 * | 12/2009 | Hung | B29C 45/14065 343/702 |
| 2011/0012790 | A1 | 1/2011 | Badaruzzaman et al. | |

(Continued)

FOREIGN PATENT DOCUMENTS

| | | | |
|---|---|---|---|
| EP | 1 638 213 | A1 | 3/2006 |
| WO | WO2012063979 | * | 5/2012 |
| WO | 2015/002359 | A1 | 1/2015 |

*Primary Examiner* — Robert Karacsony
(74) *Attorney, Agent, or Firm* — Jefferson IP Law, LLP

(57) ABSTRACT

An antenna is provided. The antenna includes a carrier having a via hole penetrating an outer surface and an inner surface thereof, a first antenna radiator formed on the outer surface of the carrier and at least a part of a surface of the carrier that defines the via hole, a second antenna radiator formed on an inner surface of the carrier and electrically contacting the first antenna radiator through the via hole, and a coupling member configured to electrically connect the second antenna radiator with a circuit board provided in the electronic device.

17 Claims, 7 Drawing Sheets

(56) References Cited

U.S. PATENT DOCUMENTS

| | | | |
|---|---|---|---|
| 2012/0068888 | A1 | 3/2012 | Tsung-Wen et al. |
| 2013/0027252 | A1 | 1/2013 | Lin |
| 2013/0307736 | A1 | 11/2013 | Larsen et al. |
| 2014/0009354 | A1 | 1/2014 | Badaruzzaman et al. |
| 2014/0118196 | A1 | 5/2014 | Koskiniemi |
| 2015/0029061 | A1 | 1/2015 | Larsen et al. |
| 2016/0182112 | A1 | 6/2016 | Kim et al. |

* cited by examiner

ANTENNA AND ELECTRONIC DEVICE COMPRISING THEREOF

CROSS-REFERENCE TO RELATED APPLICATION(S)

This application claims the benefit under 35 U.S.C. § 119(a) of a Korean patent application filed on May 8, 2015 in the Korean Intellectual Property Office and assigned Serial number 10-2015-0064653, the entire disclosure of which is hereby incorporated by reference.

TECHNICAL FIELD

The present disclosure relates to an antenna and an electronic device equipped with the antenna.

BACKGROUND

With the development of mobile communication technologies, an electronic device is able to freely connect to a wired and/or wireless network while being carried by a user. For example, a portable electronic device, such as a smartphone or a tablet personal computer (PC), is equipped with an antenna for transmitting and receiving a wireless signal, thus connecting with a wireless communication network.

The antenna is classified as an external antenna or an internal antenna, based on a position where the antenna is mounted on the portable electronic device.

The external antenna may be an antenna such as a helical antenna, a road antenna, or a dipole antenna. The external antenna protrudes to the outside of the portable electronic device.

For this reason, the external antenna has a non-directional radiation characteristic. However, the probability that the external antenna may be damaged by an external impact is high. Further, the external antenna causes an inconvenience when carrying the portable electronic device. In addition, it is difficult to design the appearance of a terminal with high aesthetics. As such, today, the internal antenna that is mounted in an interior of the portable electronic device is widely used instead of the external antenna.

The internal antenna is an antenna that is mounted in an interior of a terminal without protruding toward the outside thereof. The portable electronic device uses, for example, an internal antenna having a planar structure such as a microstrip patch antenna or a planar inverted F antenna (PIFA). The internal antenna includes a carrier formed with an insulating material. An antenna radiator that transmits and receives a wireless signal in a specific frequency band is formed on a surface of the carrier.

An antenna radiator that is applied to the internal antenna may be formed, for example, with a flexible printed circuit (FPC), by laser direct structuring (LDS), or with a direct printed antenna (DPA).

In the case where the antenna radiator is formed with the FPC, however, it is difficult to implement the antenna radiator on a three-dimensional curved area. In addition, in the case where a cover covering the antenna radiator is removed, the antenna radiator may be damaged easily. In the case where the antenna radiator is formed by the LDS, there is a limit to coat LDS resin thereon due to a characteristic of the LDS resin. For example, even though a material is coated on the resin, many limitations due to LDS painting solution are present. In addition, in the case where the antenna radiator is formed with the DPA, a press fit pin (or an insert pin) is used to connect an antenna radiator formed on inner and outer surfaces of the carrier. The press fit pin causes a stepped portion on a carrier surface due to a contact with an internal coupling member.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna that is formed using a process fit to a first antenna radiator formed of an antenna pattern or a second antenna radiator making contact with an internal coupling member and an electronic device including the antenna.

In accordance with an aspect of the present disclosure, an antenna for an electronic device is provided. The antenna includes a carrier having a via hole penetrating an inner surface and an outer surface thereof, a first antenna radiator formed on the outer surface of the carrier and on at least a part of a surface of the carrier that defines the via hole, a second antenna radiator formed on an inner surface of the carrier and electrically contacting the first antenna radiator through the via hole, and a coupling member configured to electrically connect the second antenna radiator with a circuit board provided in the electronic device.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
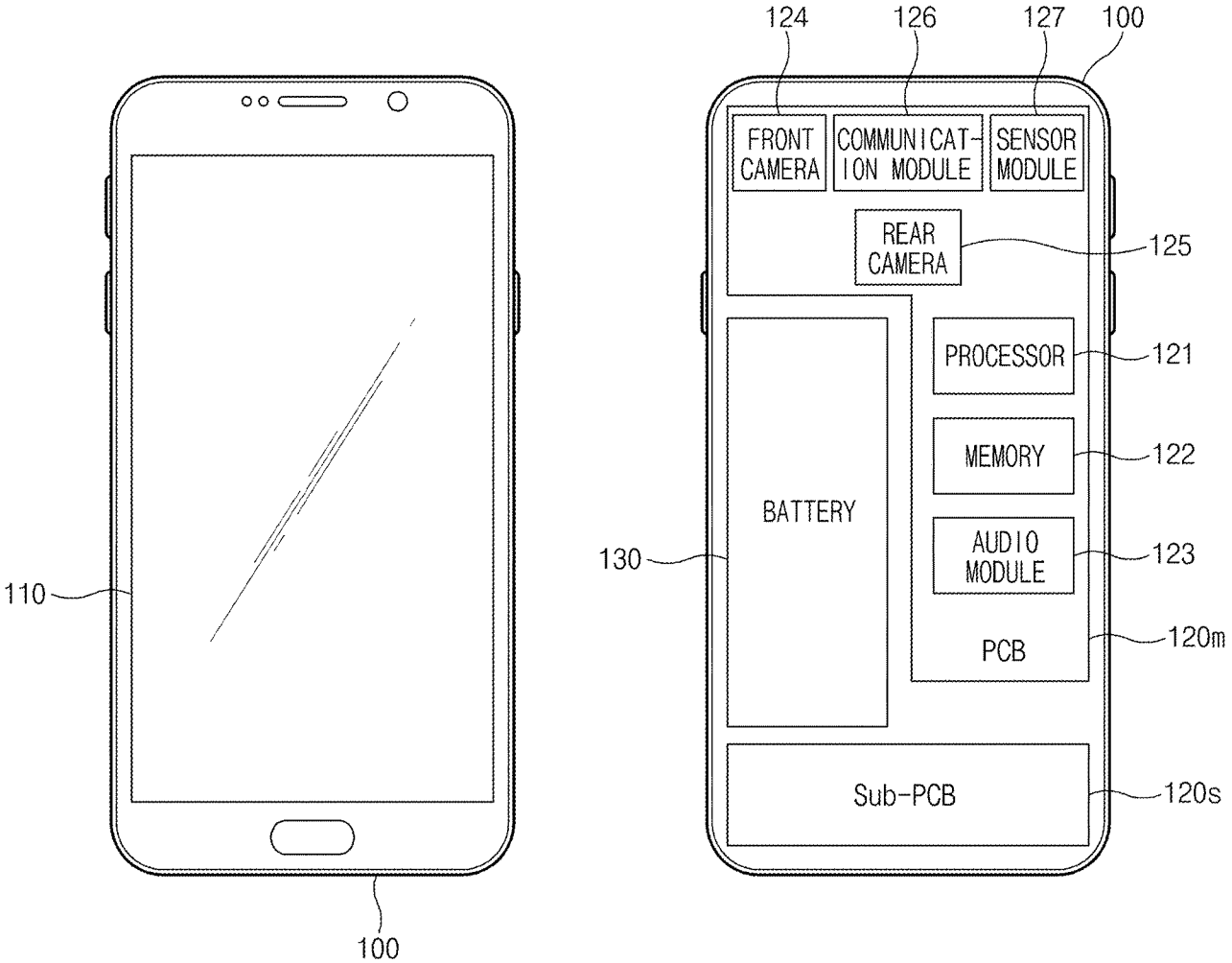
FIG. 1 is a block diagram of an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following disclosure, the expressions "have", "may have", "include" and "comprise", or "may include" and "may comprise" used herein indicate existence of corresponding features (e.g., elements such as numeric values, functions, operations, or components) but do not exclude presence of additional features.

In the following disclosure, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, "a first user device" and "a second user device" indicate different user devices regardless of the order or priority. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used herein may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other components. For example, a "processor configured to (or set to) perform A, B, and C" may mean a dedicated processor (e.g., an embedded processor) for performing a corresponding operation or a generic-purpose processor (e.g., a central processing unit (CPU) or an application processor (AP)) which performs corresponding operations by executing one or more software programs which are stored in a memory device.

Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude various embodiments of the present disclosure.

An electronic device according to various embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), Moving Picture Experts Group phase 1 or phase 2 (MPEG-1 or MPEG-2) audio layer 3 (MP3) players, mobile medical devices, cameras, or wearable devices. According to various embodiments, the wearable device may include at least one of an accessory type (e.g., watches, rings, bracelets, anklets, necklaces, glasses, contact lens, or head-mounted-devices (HMDs)), a fabric or garment-integrated type (e.g., an electronic apparel), a body-attached type (e.g., a skin pad or tattoos), or an implantable type (e.g., an implantable circuit).

According to an embodiment, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, a home automation control panel, a security control panel, TV boxes (e.g., Samsung HomeSync™, Apple TV™, or Google TV™), game consoles (e.g., Xbox™ and PlayStation™), electronic dictionaries, electronic keys, camcorders, or electronic picture frames.

According to various embodiments, the electronic device may include at least one of medical devices (e.g., various portable medical measurement devices (e.g., a blood glucose monitoring device, a heartbeat measuring device, a blood pressure measuring device, a body temperature measuring device, and the like)), a magnetic resonance angiography (MRA), a magnetic resonance imaging (MRI), a computed tomography (CT), scanners, and ultrasonic devices), navigation devices, global positioning system (GPS) receivers, event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs), or internet of things (e.g., light bulbs, various sensors, electric or gas meters, sprinkler devices, fire alarms, thermostats, street lamps, toasters, exercise equipment, hot water tanks, heaters, boilers, and the like).

According to various embodiments, the electronic devices may include at least one of parts of furniture or buildings/structures, electronic boards, electronic signature receiving devices, projectors, or various measuring instruments (e.g., water meters, electricity meters, gas meters, or wave meters, and the like). According to various embodiments, the electronic device may be one of the above-described devices or a combination thereof. An electronic device according to an embodiment may be a flexible electronic device. Furthermore, an electronic device according to an embodiment may not be limited to the above-described electronic devices and may include other electronic devices and new electronic devices according to the development of technologies.

Hereinafter, an electronic device according to an embodiment of the present disclosure will be described with reference to the accompanying drawings. The term "user" used herein may refer to a person who uses an electronic device or may refer to a device (e.g., an artificial electronic device) that uses an electronic device.

FIG. 1 is a drawing illustrating an electronic device equipped with an antenna according to various embodiments of the present disclosure.

Referring to FIG. 1, an electronic device 100 equipped with an antenna according to various embodiments of the present disclosure may include a display 110, a main circuit board 120*m* and a sub circuit board 120*s*, and a battery 130. According to an embodiment, the electronic device 100 may not include at least one of the above-described elements or may further include any other element(s).

The display 110 may be connected to the main circuit board 120*m* and the sub circuit board 120*s* and may display, for example, various kinds of content (e.g., a text, an image, a video, an icon, a symbol, and the like) in response to control of a processor 121. The display 110 may include a touch screen and may receive, for example, a touch input, a gesture input, a proximity input, or a hovering input using an electronic pen or a part of a user's body.

The main circuit board 120*m* and the sub circuit board 120*s* (collectively referred to as circuit board 120) may include, for example, a printed circuit board (PCB), a flexible printed circuit board (FPCB), or the like. In an embodiment, the circuit board 120 may be called a main board.

The circuit board 120 may include various circuit components and/or modules of the electronic device 100. For example, the processor 121, a memory 122, an audio module 123, a front camera module 124, a rear camera module 125, a communication module 126, and/or a sensor module 127 may be installed on the circuit board 120 or may be electrically connected with the circuit board 120. The battery 130 may convert chemical energy included therein into electrical energy and may supply the electrical energy to the circuit board 120. A power management module that manages the battery 130 may be installed on the circuit board 120 or may be electrically connected therewith.

According to an embodiment, the electronic device 100 may include an antenna for wireless communication. The electronic device 100 may communicate with an external device through the antenna. The antenna may include an antenna radiator for transmitting/receiving a signal of a specific frequency band. The antenna radiator may be connected with at least one of the main circuit board 120*m* or the sub circuit board 120*s*. The antenna radiator may be supplied with power from a point of the main circuit board 120*m* and the sub circuit board 120*s* and may be connected with a ground area through another point thereof.

In addition, the antenna may be electrically connected with the communication module 126. The processor 121 may control the communication module 126 to feed a signal of a specific frequency band to the antenna for transmitting or receiving. For example, the communication module 126 may feed to at least one antenna radiator (or antenna radiating body).

A structure according to an embodiment of the present disclosure in which the antenna radiator and the main circuit board 120*m* and the sub circuit board 120*s* are interconnected will be described with reference to FIG. 2.

Figure 2:
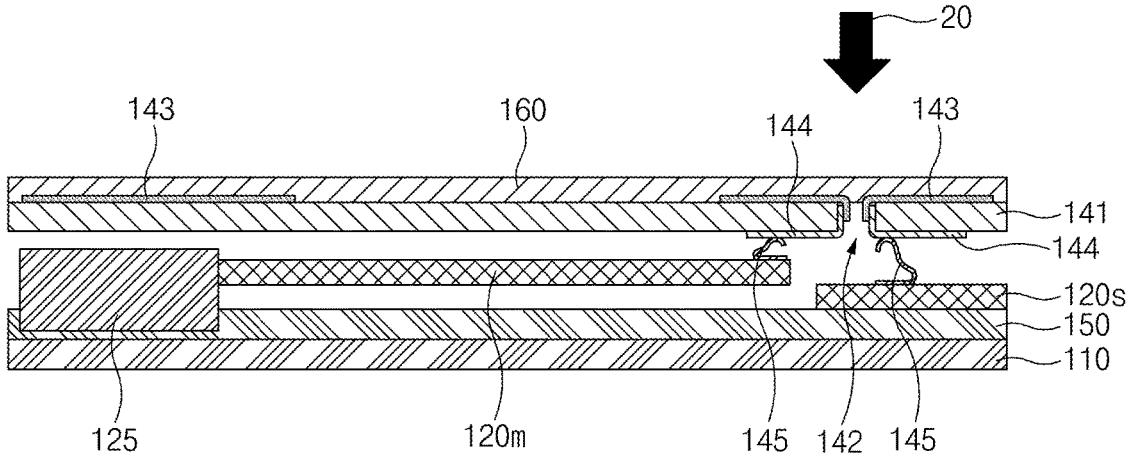
FIG. 2 is a sectional view of an electronic device equipped with an antenna according to various embodiments of the present disclosure.

FIG. 2 is a sectional view of an electronic device equipped with an antenna according to various embodiments of the present disclosure.

Referring to FIG. 2, the electronic device 100 may include a display 110, a bracket 150, the main circuit board 120*m*, the sub circuit board 120*s*, a hardware module (e.g., the rear camera module 125), a coupling member 145, a carrier 141, and a cover 160 on the bottom of the electronic device 100. The bracket 150 may physically support various elements built in the electronic device 100 such as the display 110, the circuit board (120*m*, 120*s*), the hardware module (e.g., the rear camera module 125), and the like. The cover 160 may correspond to a rear cover of the electronic device 100 and may be formed of, for example, painting, glass, thermoplastic resin, or the like.

A part of the electronic device 100 viewed from a direction of an arrow 20 may correspond to the antenna. The antenna may include the carrier 141 on which a first antenna radiator 143 and a second antenna radiator 144 are formed and the coupling member 145 that electrically connects the second antenna radiator 144, the main circuit board 120*m*, and the sub circuit board 120*s*. A via hole 142 may be formed in the carrier 141. The first antenna radiator 143 and the second antenna radiator 144 may be electrically interconnected through the via hole 142.

Figure 3:
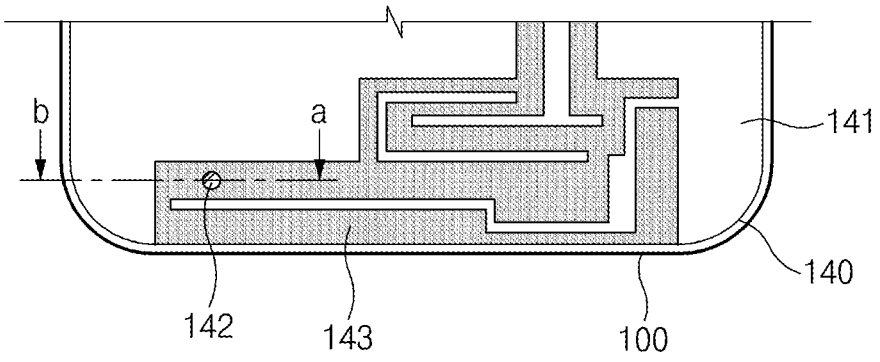
FIG. 3 is a view illustrating an antenna of an electronic device according to various embodiments of the present disclosure.

FIG. 3 is a view illustrating an antenna of an electronic device according to various embodiments of the present disclosure.

Referring to FIG. 3, an antenna 140, as viewed from the direction of the arrow 20 of FIG. 2 with the cover 160 removed, is illustrated. The antenna 140 may be installed on the electronic device 100 and may transmit and receive a wireless signal. A pattern of the first antenna radiator 143 may be formed on an outer surface of the carrier 141, and the via hole 142 may be formed at a partial surface of the carrier 141. The first antenna radiator 143 may be formed in various shapes so as to operate in a frequency band corresponding to various communication standards (e.g., long-term evolution (LTE), LTE-advanced (LTE-A), wideband code division multiple access (WCDMA), Wi-Fi, Bluetooth (BT), near field communication (NFC), or global navigation satellite system (GNSS)).

Figure 4:
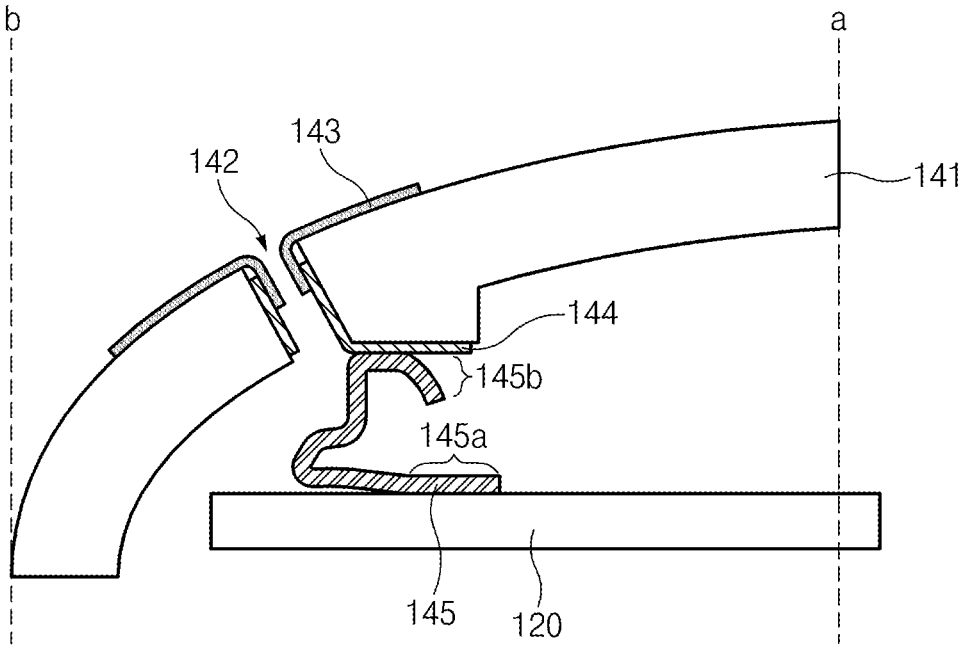
FIG. 4 is a sectional view of the antenna viewed from a lateral side when taken along a line a-b of FIG. 3 according to an embodiment of the present disclosure.

FIG. 4 is a sectional view of the antenna viewed from a lateral side when taken along a line a-b of FIG. 3 according to an embodiment of the present disclosure.

Referring to FIG. 4, an antenna according to an embodiment of the present disclosure may include the carrier 141, the via hole 142, the first antenna radiator 143, the second antenna radiator 144, and the coupling member 145.

The circuit board 120 (e.g., the main circuit board 120*m* or the sub circuit board 120*s* of FIG. 1) and the antenna radiator 143 on an outer surface of the carrier 141 may be physically spaced from each other by the carrier 141. In the carrier 141, the first antenna radiator 143 may be formed on the outer surface of the carrier 141, and the second antenna radiator 144 may be formed on an inner surface of the carrier 141. In addition, the carrier 141 may have the via hole (or a through hole) 142 that penetrates the inner surface and the outer surface of the carrier 141.

When formed on the outer surface of the carrier 141, the first antenna radiator 143 may be formed on at least a part of a surface of the carrier 141 that defines the via hole 142. In addition, the first antenna radiator 143 and the second antenna radiator 144 may be electrically interconnected through the via hole 142.

According to an embodiment, the first antenna radiator 143 or the second antenna radiator 144 may extend along the surface of the carrier 141 that defines the via hole 142 so that the first antenna radiator 143 and the second antenna radiator 144 are electrically interconnected. As such, a power may be supplied to the first antenna radiator 143 from the circuit board 120 through the coupling member 145 and the second antenna radiator 144.

The first antenna radiator 143 may be formed by a direct printed antenna (DPA) process to have a predetermined pattern (e.g., a pattern of the first antenna radiator 143 illustrated in FIG. 3). The DPA process may be a process of injection-molding the carrier 141 and then filling a silver (Ag) paste in a corrosion plate having the shape of an antenna radiator to print an antenna radiator in the carrier 141 through pad printing. The antenna radiator formed by the DPA process may be referred to as a DPA radiator.

The second antenna radiator 144 may be formed by a laser direct structuring (LDS) process. The LDS process may be a process of attaching an LDS resin (for example, an injection-molded thermoplastic product) to the carrier 141 through injection-molding or the like, selectively patterning the LDS resin by applying a laser beam to the LDS resin, and plating the patterned LDS with copper (Cu) and nickel (Ni) by an anchoring phenomenon. The antenna radiator formed by the LDS process may be referred to as LDS antenna radiator.

Another type of antenna such as an antenna that uses an SUS fusion process of punching a pattern of an antenna radiator with a metal piece and then thermally fusing the pattern in the carrier, in addition to the LDS process, or an FPC antenna may be applied as the second antenna radiator 144.

The coupling member 145 may electrically connect the second antenna radiator 144 and the circuit board 120 provided in the electronic device 100. The coupling member 145 may correspond to an elastic member having elasticity. For example, the coupling member 145 may correspond to a C-clip or a wire spring.

According to an embodiment, the coupling member 145 may include a flat portion 145*a*, which makes contact with the circuit board 120, and a bending portion 145*b*. The bending portion 145*b* may extend from the flat portion 145*a* and may make contact with the second antenna radiator 144. That is, the bending portion 145*b* of the coupling member 145 may be electrically connected with a portion of the second antenna radiator 144 formed on an inner surface of the carrier 141.

According to an embodiment of the present disclosure, a type (e.g., a manufacturing process) of the first antenna radiator 143 formed on the outer surface of the carrier 141 may be different from that of the second antenna radiator 144 formed on the inner surface of the carrier 141. The coupling member 145 may make contact with the second antenna radiator 144 that is formed on the inner surface of the carrier 141. The DPA antenna radiator that is unsuitable to form a pattern on an inner wall of a via hole may be used on the outer surface of the carrier 141, and the LDS antenna radiator that is unsuitable for external printing may be used on the inner surface thereof. Accordingly, it may be possible to overcome difficulty due to a material of an antenna radiator.

Figure 5:
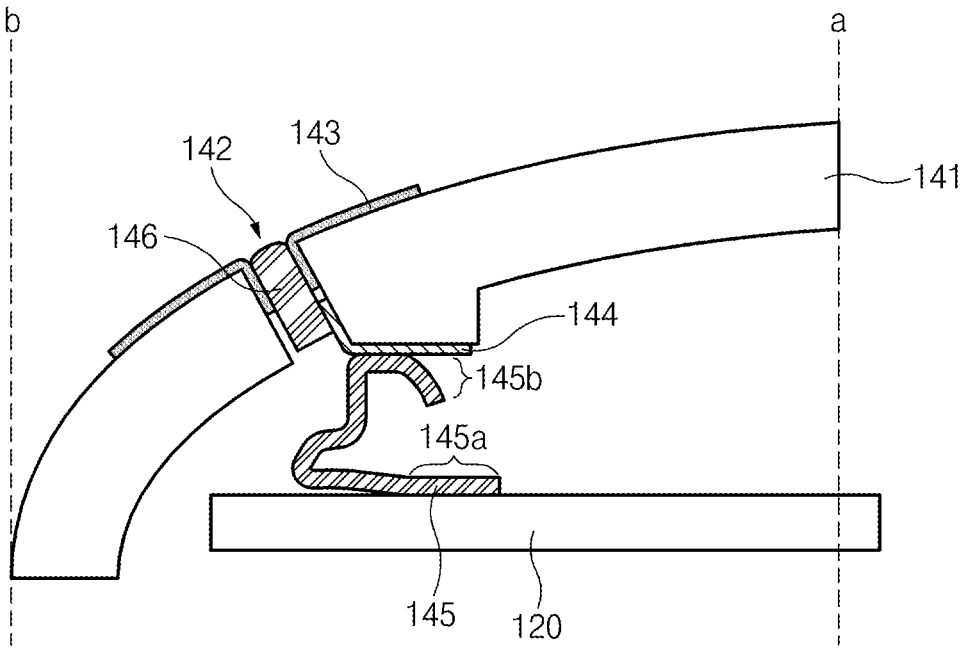
FIG. 5 is a sectional view of an antenna into which a contact pin is inserted according to an embodiment of the present disclosure.

FIG. 5 is a sectional view of an antenna into which a contact pin is inserted according to an embodiment of the present disclosure.

Referring to FIG. 5, an antenna according to an embodiment of the present disclosure may include the carrier 141, the via hole 142, the first antenna radiator 143, the second antenna radiator 144, the coupling member 145, and a contact pin (or referred to as insert pin or press fit pin) 146 that is inserted into and coupled with the via hole 142. With regard to FIG. 4, a duplicated description is omitted.

According to an embodiment, the first antenna radiator 143 and the second antenna radiator 144 may be electrically interconnected through the contact pin 146. For example, in the case where the contact pin 146 corresponds to an insulating material (e.g., thermoplastic resin), the LDS process may be applied to a surface of the contact pin 146. The contact pin 146 may have electrical conductivity by the LDS process. In another embodiment, the contact pin 146 may correspond to a metal pin. After the first antenna radiator 143 and the second antenna radiator 144 are formed, the above-described contact pin 146 may be inserted into and coupled with the via hole 142 formed in the carrier 141.

The coupling member 145 that electrically connects the second antenna radiator 144 and the circuit board 120 may be electrically connected with the second antenna radiator 144 through a direct contact. In this case, the coupling member 145 may be physically spaced apart from the contact pin 146 inserted into the via hole 142. That is, the coupling member 145 may not make physical contact with the contact pin 146.

According to an embodiment of the present disclosure, in addition to a feature described with reference to FIG. 4, the coupling member 145 may make direct contact with the carrier 141 on which the second antenna radiator 144 is formed. Accordingly, in the case where the contact pin 146 makes direct contact with the coupling member 145, the removal of the contact pin 146 due to an elastic force of the coupling member 145 may be prevented.

In addition, even though the first antenna radiator 143 and the second antenna radiator 144 are not directly connected in the via hole 142, a wireless signal may be transmitted and received through the contact pin 146 that is inserted into the via hole 142.

Figure 6:
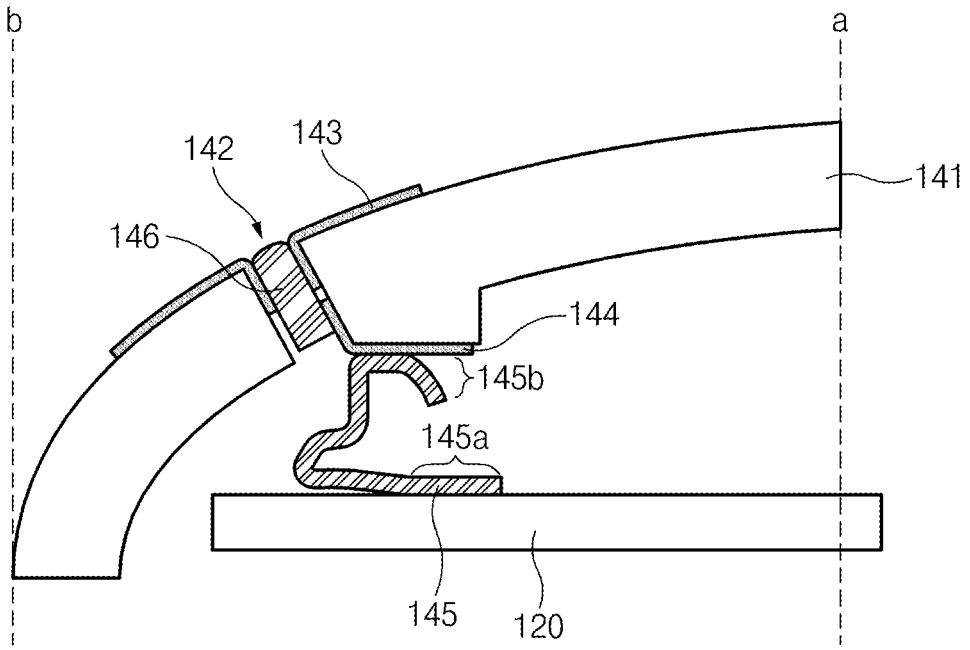
FIG. 6 is a sectional view of an antenna according to an embodiment of the present disclosure.

FIG. 6 is a sectional view of an antenna according to an embodiment of the present disclosure.

Referring to FIG. 6, an antenna according to an embodiment of the present disclosure may include the carrier 141, the via hole 142, the first antenna radiator 143, the second antenna radiator 144, the coupling member 145, and the contact pin 146 that is inserted into and coupled with the via hole 142. With regard to FIGS. 4 and 5, a duplicated description is omitted.

According to an embodiment, the first antenna radiator 143 and the second antenna radiator 144 may be formed by the same process. For example, the first antenna radiator 143 and the second antenna radiator 144 may be formed by the DPA process so as to have the same physical property. In this case, the contact pin 146 may be, for example, a metal pin.

In general, in the case where each of the first antenna radiator 143 and the second antenna radiator 144 is implemented with the DPA process without the insertion and coupling of the contact pin 146, there is a need to make the via hole 142 wide, thereby causing a disconnection of a radiator pattern in the via hole 142.

However, according to an embodiment in which the first antenna radiator 143 and the second antenna radiator 144 are implemented with the DPA process, in addition to a feature described with reference to FIG. 5, the above-described disconnection of a pattern and an increase in a stepped portion on an outer surface of the carrier 141 due to a wide head of a metal pin may be addressed. In addition, according to an embodiment of the present disclosure, as a cause of the increase in the stepped portion is lapsed due to its structure, an additional cover for preventing the increase in the stepped portion may not be used.

Figure 7:
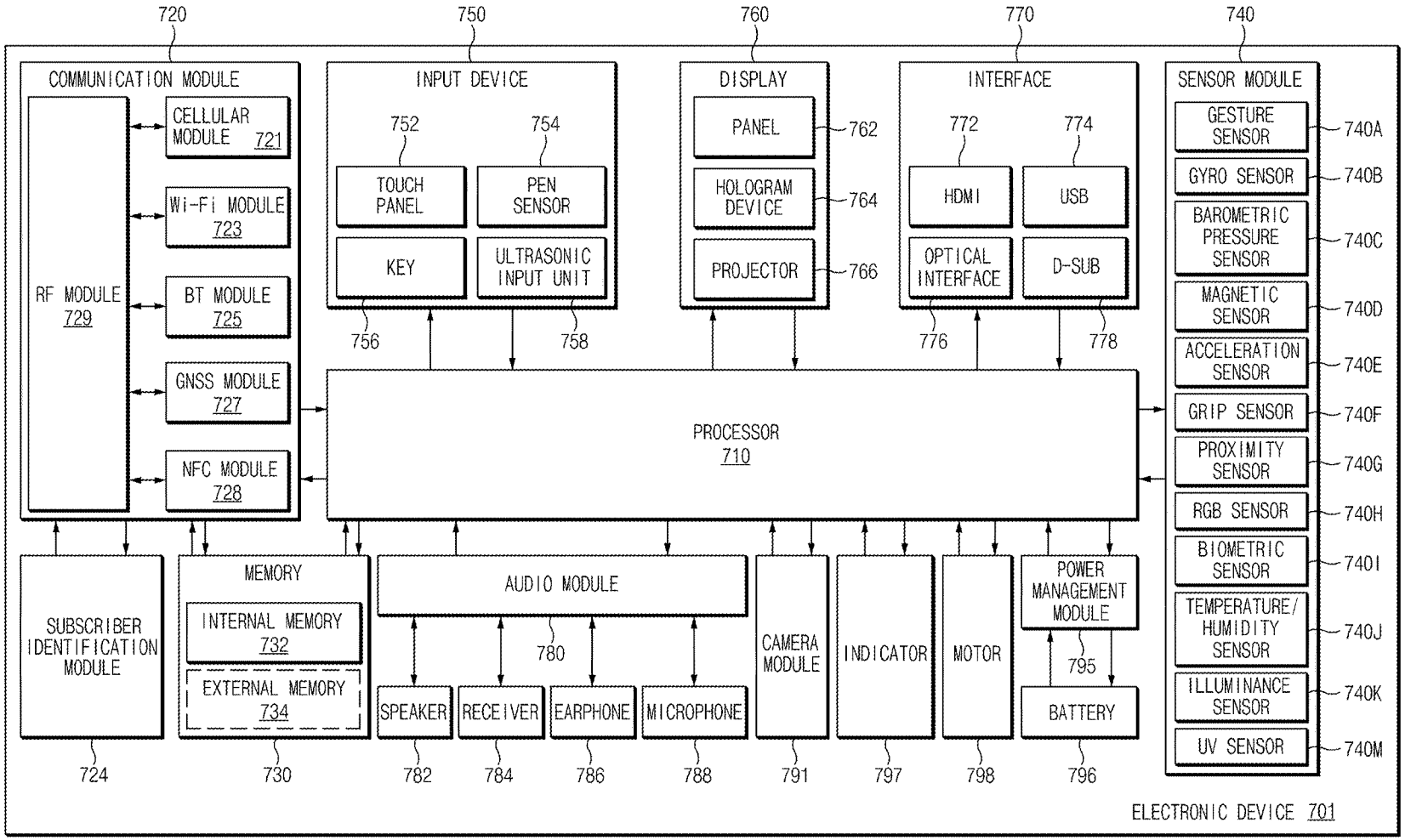
FIG. 7 is a block diagram of an electronic device according to various embodiments of the present disclosure.

FIG. 7 is a block diagram illustrating an electronic device according to various embodiments of the present disclosure.

Referring to FIG. 7, an electronic device 701 may include, for example, all or a part of an electronic device 100 illustrated in FIG. 1. The electronic device 701 may include one or more processors (e.g., an AP) 710, a communication module 720, a subscriber identification module (SIM) 724, a memory 730, a sensor module 740, an input device 750, a display 760, an interface 770, an audio module 780, a camera module 791, a power management module 795, a battery 796, an indicator 797, and a motor 798.

The processor 710 (e.g., the processor 121 of FIG. 1) may drive an operating system (OS) or an application to control a plurality of hardware or software elements connected to the processor 710 and may process and compute a variety of data. The processor 710 may be implemented with a system on chip (SoC), for example. According to an embodiment, the processor 710 may further include a graphics processing unit (GPU) and/or an image signal processor (ISP). The processor 710 may include at least a part (e.g., a cellular module 721) of other elements illustrated in FIG. 7. The processor 710 may load and process an instruction or data, which is received from at least one of other elements (e.g., a nonvolatile memory), and may store a variety of data at a nonvolatile memory.

The communication module 720 may be configured the same as or similar to the communication module 126 of FIG. 1. The communication module 720 may include the cellular module 721, a Wi-Fi module 723, a BT module 725, a GNSS module 727 (e.g., a GPS module, a Glonass module, Beidou module, or a Galileo module), an NFC module 728, and a radio frequency (RF) module 729.

The cellular module 721 may provide, for example, voice communication, video communication, a character service, an Internet service, or the like through a communication network. According to an embodiment, the cellular module 721 may perform discrimination and authentication of the electronic device 701 within a communication network using the SIM 724 (e.g., a SIM card), for example. According to an embodiment, the cellular module 721 may perform at least a part of functions that the processor 710 provides. According to an embodiment, the cellular module 721 may include a communication processor (CP).

Each of the Wi-Fi module 723, the BT module 725, the GNSS module 727, and the NFC module 728 may include a processor for processing data exchanged through a corresponding module, for example. According to an embodiment, at least a part (e.g., two or more elements) of the cellular module 721, the Wi-Fi module 723, the BT module 725, the GNSS module 727, and the NFC module 728 may be included within one integrated circuit (IC) or an IC package.

The RF module 729 may transmit and receive, for example, a communication signal (e.g., an RF signal). The RF module 729 may include, for example, a transceiver, a power amplifier module (PAM), a frequency filter, a low noise amplifier (LNA), an antenna, or the like. The RF chip 729 may include an antenna such as the antenna illustrated in FIGS. 3 to 6. According to various embodiments, at least one of the cellular module 721, the Wi-Fi module 723, the BT module 725, the GNSS module 727, or the NFC module 728 may transmit and receive an RF signal through a separate RF module.

The SIM 724 may include, for example, a card, including a SIM, and/or an embedded SIM and may include unique identification information (e.g., integrated circuit card identifier (ICCID)) or subscriber information (e.g., integrated mobile subscriber identity (IMSI)).

The memory 730 (e.g., the memory 122) may include an internal memory 732 or an external memory 734. For example, the internal memory 732 may include at least one of a volatile memory (e.g., a dynamic random access memory (DRAM), a static RAM (SRAM), or a synchronous DRAM (SDRAM)), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a NAND flash memory, or a NOR flash memory), a hard drive, or a solid state drive (SSD).

The external memory 734 may include a flash drive, for example, compact flash (CF), secure digital (SD), micro-SD, mini-SD, extreme digital (xD), multimedia card (MMC), a memory stick, or the like. The external memory 734 may be functionally and/or physically connected with the electronic device 701 through various interfaces.

The sensor module 740 may measure, for example, a physical quantity or may detect an operation status of the electronic device 701. The sensor module 740 may convert the measured or detected information to an electrical signal. The sensor module 740 may include at least one of, for example, a gesture sensor 740A, a gyro sensor 740B, a barometric pressure sensor 740C, a magnetic sensor 740D, an acceleration sensor 740E, a grip sensor 740F, a proximity sensor 740G, a color sensor 740H (e.g., red, green, blue (RGB) sensor), a biometric sensor 740I, a temperature/humidity sensor 740J, an illuminance sensor 740K, or an ultraviolet (UV) sensor 740M. Even though not illustrated, additionally or alternatively, the sensor module 740 may include, for example, an E-nose sensor, an electromyography sensor (EMG) sensor, an electroencephalogram (EEG) sensor, an electrocardiogram (ECG) sensor, an infrared (IR) sensor, an iris sensor, and/or a fingerprint sensor. The sensor module 740 may further include a control circuit for controlling at least one or more sensors included therein. According to an embodiment, the electronic device 701 may further include a processor which is a part of the processor 710 or independent of the processor 710 and which is configured to control the sensor module 740. The processor may control the sensor module 740 while the processor 710 remains in a sleep state.

The input device 750 may include, for example, a touch panel 752, a (digital) pen sensor 754, a key 756, or an ultrasonic input unit 758. The touch panel 752 may use at least one of capacitive, resistive, infrared and ultrasonic detecting methods. Also, the touch panel 752 may further include a control circuit. The touch panel 752 may further include a tactile layer to provide a tactile reaction to a user.

The (digital) pen sensor 754 may be, for example, a part of a touch panel or may include an additional sheet for recognition. The key 756 may include, for example, a physical button, an optical key, a keypad, and the like. The ultrasonic input device 758 may detect (or sense) an ultrasonic signal, which is generated from an input device, through a microphone (e.g., a microphone 788) and may verify data corresponding to the detected ultrasonic signal.

The display 760 may include a panel 762, a hologram device 764, or a projector 766. The panel 762 may be configured the same as or similar to the display 110 of FIG. 1. The panel 762 may be implemented to be flexible, transparent or wearable, for example. The panel 762 and the touch panel 752 may be integrated into a single module. The hologram device 764 may display a stereoscopic image in a space using a light interference phenomenon. The projector 766 may project light onto a screen so as to display an image. The screen may be arranged inside or outside the electronic device 701. According to an embodiment, the display 760 may further include a control circuit for controlling the panel 762, the hologram device 764, or the projector 766.

The interface 770 may include, for example, a high-definition multimedia interface (HDMI) 772, a universal serial bus (USB) 774, an optical interface 776, or a D-sub-miniature (D-sub) 778. Additionally or alternatively, the interface 770 may include, for example, a mobile high definition link (MHL) interface, a SD card/MMC interface, or an infrared data association (IrDA) standard interface.

The audio module 780 may convert a sound and an electrical signal in dual directions. The panel 780 may be configured the same as or similar to the audio module 123 of FIG. 1. The audio module 780 may process, for example, sound information that is input or output through a speaker 782, a receiver 784, an earphone 786, or the microphone 788.

The camera module 791 that shoots shooting a still image or a video may include, for example, at least one image sensor (e.g., the front camera module 124 or the rear camera module 125 of FIG. 1), a lens, an ISP, or a flash (e.g., a light-emitting diode (LED) or a xenon lamp).

The power management module 795 may manage, for example, power of the electronic device 701. According to an embodiment, a power management integrated circuit (PMIC) a charger integrated circuit (IC), or a battery or fuel gauge may be included in the power management module 795. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 796 (e.g., the battery 130 of FIG. 1) and a voltage, current or temperature thereof while the battery is charged. The battery 796 may include, for example, a rechargeable battery or a solar battery.

The indicator 797 may display a specific state of the electronic device 701 or a part thereof (e.g., the processor 710), such as a booting state, a message state, a charging state, and the like. The motor 798 may convert an electrical signal into a mechanical vibration and may generate a vibration effect, a haptic effect, and the like. Even though not illustrated, a processing device (e.g., a GPU) for supporting a mobile TV may be included in the electronic device 701. The processing device for supporting a mobile TV may process media data according to the standards of digital multimedia broadcasting (DMB), digital video broadcasting (DVB), MediaFlo™, or the like.

Each of the above-mentioned elements of the electronic device according to various embodiments of the present disclosure may be configured with one or more components, and the names of the elements may be changed according to the type of the electronic device. The electronic device according to various embodiments of the present disclosure may include at least one of the above-mentioned elements, and some elements may be omitted or other additional elements may be added. Furthermore, some of the elements of the electronic device according to various embodiments of the present disclosure may be combined with each other so as to form one entity, so that the functions of the elements may be performed in the same manner as before the combination.

The term "module" used herein may represent, for example, a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

An antenna according to various embodiments of the present disclosure may use an antenna radiator that is formed using a process fit to a first antenna radiator formed of an antenna pattern or a second antenna radiator making contact with an internal coupling member.

Compared to an antenna implemented with an antenna radiator of a single type, the antenna according to various embodiments of the present disclosure may obtain high endurance and may cope with various applications and modifications to be applied to products.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna for an electronic device, the antenna comprising:

a carrier including a via hole;

a first antenna radiator formed on an outer surface of the carrier and on at least a part of a surface of the carrier that defines the via hole;

a second antenna radiator formed on an inner surface of the carrier and electrically contacting the first antenna radiator through the via hole;

a coupling member configured to electrically connect the second antenna radiator with a circuit board provided in the electronic device; and a contact pin configured for insertion into and coupling with the via hole, wherein the first antenna radiator and the second antenna radiator are electrically interconnected through the contact pin.

2. The antenna of claim 1, wherein the first antenna radiator or the second antenna radiator extends along the surface of the carrier that defines the via hole to allow the first antenna radiator and the second antenna radiator to be electrically interconnected.

3. The antenna of claim 1, wherein the first antenna radiator corresponds to a direct printed antenna (DPA) radiator.

4. The antenna of claim 1, wherein the second antenna radiator corresponds to a laser direct structuring (LDS) antenna radiator.

5. The antenna of claim 1, wherein the first antenna radiator and the second antenna radiator are formed by a same process.

6. The antenna of claim 1, wherein the coupling member comprises:

a flat portion configured to contact the circuit board; and a bending portion extending from the flat portion and configured to contact the second antenna radiator.

7. The antenna of claim 1, wherein the coupling member comprises an elastic member.

8. The antenna of claim 7, wherein the elastic member comprises a clip.

9. The antenna of claim 1, wherein the coupling member makes contact with the second antenna radiator and is physically spaced apart from the contact pin.

10. The antenna of claim 1, wherein a laser direct structuring (LDS) process is applied to a surface of the contact pin.

11. The antenna of claim 1, wherein the contact pin comprises a metal.

12. An electronic device including an antenna for communication with an external device, wherein the antenna comprises:

a carrier including a via hole;

a first antenna radiator formed on an outer surface of the carrier and on at least a part of a surface of the carrier that defines the via hole;

a second antenna radiator formed on an inner surface of the carrier and electrically connected with the first antenna radiator through the via hole;

a coupling member configured to electrically connect the second antenna radiator with a circuit board provided in the electronic device; and a contact pin configured for insertion into and coupling with the via hole, and wherein the first antenna radiator and the second antenna radiator are electrically interconnected through the contact pin.

13. The antenna of claim 12, wherein the first antenna radiator or the second antenna radiator extends along the surface of the carrier that defines the via hole to allow the first antenna radiator and the second antenna radiator to be electrically interconnected.

14. The antenna of claim 12, wherein the first antenna radiator corresponds to a direct printed antenna (DPA) radiator.

15. The antenna of claim 12, wherein the second antenna radiator corresponds to a laser direct structuring (LDS) antenna radiator.

16. An electronic device comprising:

at least one processor;

a transceiver; and an antenna electrically connected with the transceiver, wherein the antenna comprises:

a carrier including a via hole;

a first antenna radiator formed on an outer surface of the carrier and on at least a part of a surface of the carrier that defines the via hole;

a second antenna radiator formed on an inner surface of the carrier and electrically connected with the first antenna radiator through the via hole;

a coupling member configured to electrically connect the second antenna radiator with the transceiver; and a contact pin configured for insertion into and coupling with the via hole, wherein the first antenna radiator and the second antenna radiator are electrically interconnected through the contact pin, and wherein the at least one processor is configured to control the transceiver to transmit to or receive from the antenna a signal of a specific frequency band.

17. The antenna of claim 1, wherein the circuit board comprises:

a main circuit board, and a sub circuit board, wherein the coupling member is further configured to electrically connect the second antenna radiator with at least one of the main circuit board or the sub circuit board.

* * * * *